US009590354B2

(12) United States Patent
Kobayashi et al.

(10) Patent No.: US 9,590,354 B2
(45) Date of Patent: Mar. 7, 2017

(54) CONNECTOR AND CONNECTION STRUCTURE OF CONNECTOR

(71) Applicant: YAZAKI CORPORATION, Tokyo (JP)

(72) Inventors: Tooru Kobayashi, Makinohara (JP); Hisaya Shibata, Makinohara (JP); Hideki Homma, Tokyo (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/951,691

(22) Filed: Nov. 25, 2015

(65) Prior Publication Data

US 2016/0156128 A1 Jun. 2, 2016

(30) Foreign Application Priority Data

Nov. 27, 2014 (JP) ..... 2014-240025

(51) Int. Cl.
*H01R 13/627* (2006.01)

(52) U.S. Cl.
CPC ..... *H01R 13/6273* (2013.01)

(58) Field of Classification Search
CPC ..... H01R 13/6271; H01R 13/6275
USPC ..... 439/352, 358
See application file for complete search history.

(56) References Cited

U.S. PATENT DOCUMENTS 5,330,366 A * 7/1994 Tsuji ..... H01R 13/633 439/352
6,106,321 A * 8/2000 Yoshida ..... H01R 13/6272 439/310
2014/0073168 A1* 3/2014 Watanabe ..... H01R 13/627 439/345

FOREIGN PATENT DOCUMENTS

JP 2007-220362 A 8/2007
JP 2014-056699 A 3/2014

OTHER PUBLICATIONS

Communication dated Dec. 6, 2016, issued by the Japanese Patent Office in counterpart Japanese application No. 2014-240025.

* cited by examiner

*Primary Examiner* — Phuong Dinh
(74) *Attorney, Agent, or Firm* — Sughrue Mion, PLLC

(57) ABSTRACT

A connector includes a connector housing to be fitted to a counterpart connector housing, a pair of lock arms integrally formed on the connector housing and configured to be engaged with a pair of connecting engagement portions of the counterpart connector housing to lock a state of the connector housings fitted to each other, a pair of wedge pieces configured to be assembled into a wedge insertion hole in the connector housing so as to be movable from a standby position to an unlocking position in the connector housing, the pair of wedge pieces being configured to release, when the pair of wedge pieces are pressed to the unlocking position, a locking of the connector housings fitted to each other. Each of the wedge pieces and the wedge insertion hole has an asymmetrical front and rear cross-sectional shape.

4 Claims, 24 Drawing Sheets

CONNECTOR AND CONNECTION STRUCTURE OF CONNECTOR

CROSS REFERENCE TO RELATED APPLICATION

This application is based on Japanese Patent Application (No. 2014-240025) filed on Nov. 27, 2014, the contents of which are incorporated herein by reference. Also, all the references cited herein are incorporated as a whole.

BACKGROUND OF THE INVENTION

1. Technical Field

The present invention relates to a connector and a connection structure of the connector that are capable of allowing one connector housing and the other connector housing to be unlocked from each other by pressing an unlocking member provided in the one connector housing.

2. Background Art

JP-A-2014-56699 discloses a connector capable of allowing one connector housing and the other connector housing to be unlocked from each other by pressing an unlocking member having a pair of wedge pieces and provided in the one connector housing.

The connector disclosed in JP-A-2014-56699 functions as follows. Once the second connector housing (connector housing) is properly fitted to the first connector housing (counterpart connector housing), a pair of lock arms provided on the lateral sides of the second connector housing are in engagement with a pair of connecting engagement portions provided on the lateral sides of the first connector housing, thus locking the connector housings fitted to each other.

The second connector housing of the connector disclosed in JP-A-2014-56699 includes: arm operating pieces that are provided integrally with the lock arms and deflect the lock arms in a disengaging direction upon being pressed toward an inner space of the housing; and the unlocking member to be pushed to an unlocking position so as to press the arm operating arms toward the inner space of the housing, thus unlocking the connector housings from each other.

The pair of wedge pieces of the connector disclosed in JP-A-2014-56699 are inserted into a wedge insertion hole in the second connector housing and thus assembled into the second connector housing. The pair of wedge pieces are brought into engagement with the outer surfaces of free ends of the arm operating pieces, and are thus temporarily retained at a standby position. The pair of wedge pieces include unlocking tapered surfaces to press the outer surfaces of the free ends of the arm operating pieces toward the inner space of the housing so as to move the lock arms in an unlocking direction when the pair of wedge pieces are pushed to the unlocking position from the standby position.

Unfortunately, the connector disclosed in JP-A-2014-56699 has problems described below. The wedge insertion hole, provided in the second connector housing to allow the unlocking member to be assembled into the second connector housing, has symmetrical front and rear cross-sectional shapes. Thus, if the front and rear of the unlocking member are reversed, the unlocking member is still allowed to be inserted into the wedge insertion hole, making it impossible to prevent improper assembly of the unlocking member into the second connector housing.

The unlocking member of the connector disclosed in JP-A-2014-56699 is temporarily retained at the standby position by being engaged with the arm operating pieces integral with the lock arms. Thus, when the lock arms are deflected and displaced in the unlocking direction in the course of fitting the connector housings to each other, the deflection of the arm operating pieces responsive to the deflection and displacement of the lock arms reduces the area of engagement between the unlocking member and the arm operating pieces. This may release the temporary retainment of the unlocking member and result in disengagement of the unlocking member in the course of fitting the connector housings to each other.

SUMMARY

Accordingly, to solve the above problems, an object of the present invention is to provide a connector and a connection structure of the connector that are capable of reliably preventing improper assembly of an unlocking member into a connector housing including lock arms.

The above object of the present invention is achieved by the features described below.

(1) A connector including:

a connector housing configured to be fitted to a counterpart connector housing;

a pair of lock arms integrally formed on the connector housing, and configured to be engaged with a pair of connecting engagement portions of the counterpart connector housing to lock a state where the connector housings fitted to each other;

a pair of wedge pieces configured to be assembled into a wedge insertion hole in the connector housing so as to be movable from a standby position to an unlocking position in the connector housing, the pair of wedge pieces being configured to release, when the pair of wedge pieces are pressed to the unlocking position, a locking of the connector housings fitted to each other effected by the lock arms; and wherein each of the wedge pieces and the wedge insertion hole has an asymmetrical front and rear cross-sectional shape.

(2) The connector according to the item (1), wherein engagement protrusions are provided at distal end outer surfaces of the wedge pieces; wherein the engagement protrusions are engaged with engagement segments to prevent the wedge pieces from moving out of the standby position, the engagement segments being formed at a portion of the connector housing where deflection and deformation of the lock arms are not affected when the wedge pieces are at the standby position; and wherein each of the engagement protrusions has an asymmetrical front and rear cross-sectional shape.

(3) The connector according to the item (2), wherein the engagement protrusions of the wedge pieces are deviated from a center of gravity of the wedge pieces; and wherein end portions of distal surfaces of the engagement protrusions close to the center of gravity are provided with inclined surfaces to allow the wedge pieces abutting against a peripheral edge of the wedge insertion hole to tilt.

(4) A connection structure of a connector for connecting a counterpart connector housing and a connector housing configured to be fitted to the counterpart connector housing, the connection structure including:

a pair of lock arms integrally formed on the connector housing, and configured to be engaged with a pair of connecting engagement portions of the counterpart connector housing to lock a state where the connector housings fitted to each other;

a pair of wedge pieces configured to be assembled into a wedge insertion hole in the connector housing so as to be movable from a standby position to an unlocking position in the connector housing, the pair of wedge pieces being configured to release, when the pair of wedge pieces are pressed to the unlocking position, a locking of the connector housings fitted to each other effected by the lock arms; and wherein each of the wedge pieces and the wedge insertion hole has an asymmetrical front and rear cross-sectional shape.

The connector according to the item (1) and the connection structure according to the item (4) are configured so that the pair of wedge pieces and the wedge insertion hole, into which the pair of wedge pieces are to be inserted, each have asymmetrical front and rear cross-sectional shapes. Thus, if an attempt is made to assemble the pair of wedge pieces into the connector housing, with the front and rear of the pair of wedge pieces reversed, the pair of wedge pieces will not be inserted into the wedge insertion hole of the connector housing. Consequently, improper insertion of the unlocking member is prevented with reliability.

The connector according to the item (2) is configured so that the engagement segments of the second connector housing, which are in engagement with the engagement protrusions of the pair of wedge pieces at the standby position, are involved in neither deflection nor deformation of the lock arms. Thus, when the lock arms deflect and deform in the course of fitting the connector housings to each other, the area of engagement between the engagement protrusions of the wedge pieces and the engagement segments of the second connector housing will not decrease. Accordingly, the temporary retainment of the wedge pieces will not be loosened by the decrease in the area of engagement between the engagement protrusions of the wedge pieces and the engagement segments of the second connector housing. Consequently, the standby state of the wedge pieces is maintained with stability, and thus the reliability of the temporary retainment of the wedge pieces is improved.

The connector according to the item (3) is configured so that if the unlocking member is improperly assembled into the connector housing, the wedge pieces assembled into the connector housing will tilt under the load applied to the center of gravity of the wedge pieces, with the tapered surfaces on the distal surfaces of the engagement protrusions serving as supporting points. Consequently, improper assembly of the unlocking member into the connector housing is detected with ease and reliability.

The connector and the connection structure according to the present invention include the pair of wedge pieces and the wedge insertion hole in the connector housing, each having asymmetrical front and rear cross-sectional shapes. Thus, improper assembly of the unlocking member into the connector housing is prevented with reliability.

The present invention has been briefly described thus far. The details of the present invention will be more clearly understood by reading the following description of the embodiment of the invention with reference to the accompanying drawings.

DETAILED DESCRIPTION OF THE EXEMPLARY EMBODIMENTS

A connector and a connection structure according to a preferred embodiment of the present invention will now be described in detail with reference to the drawings.

Figure 1:
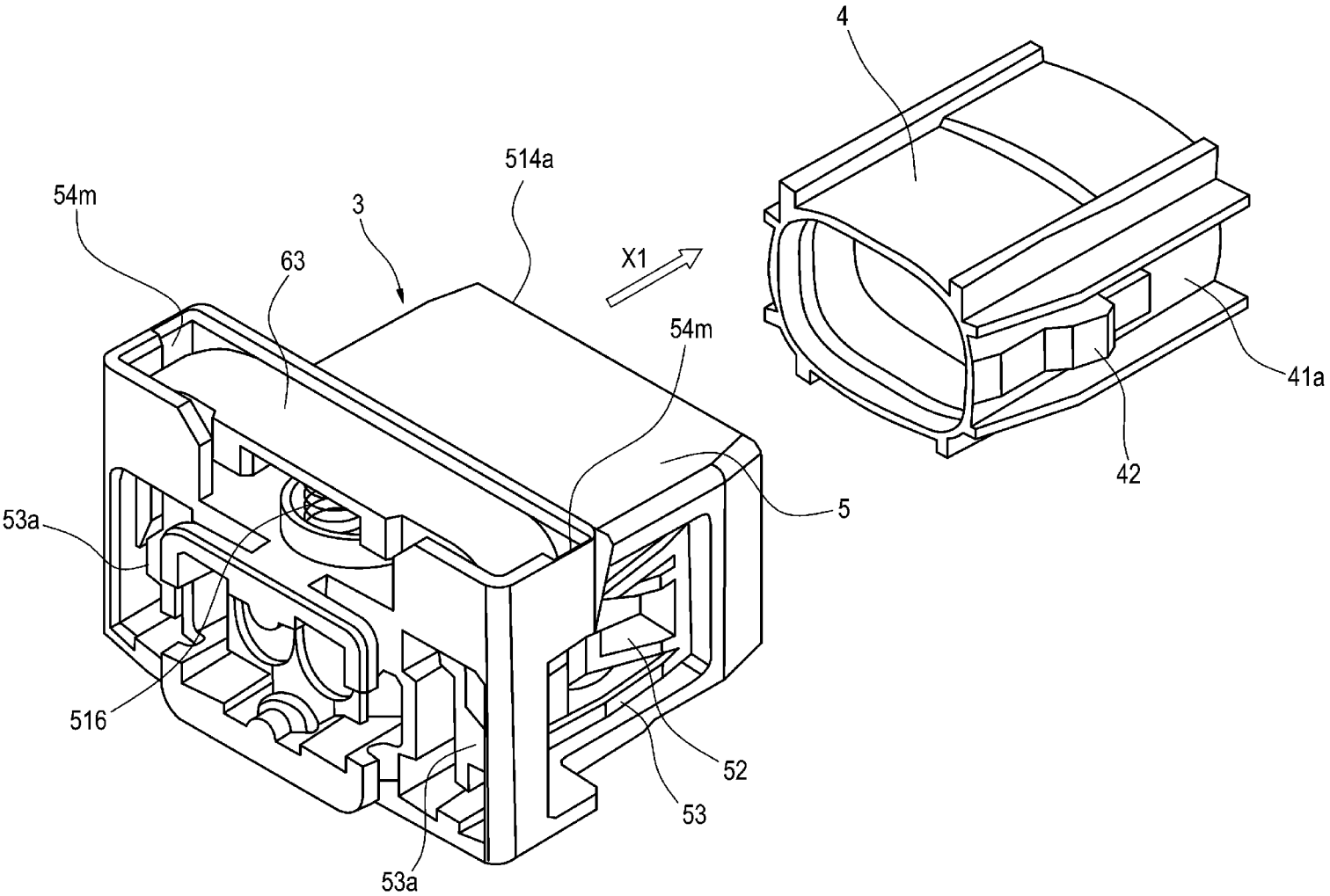
FIG. 1 is an exploded perspective view of a connector according to one embodiment of the present invention including a connector housing in which an unlocking member is temporarily retained, and a counterpart connector housing.
Figure 2:
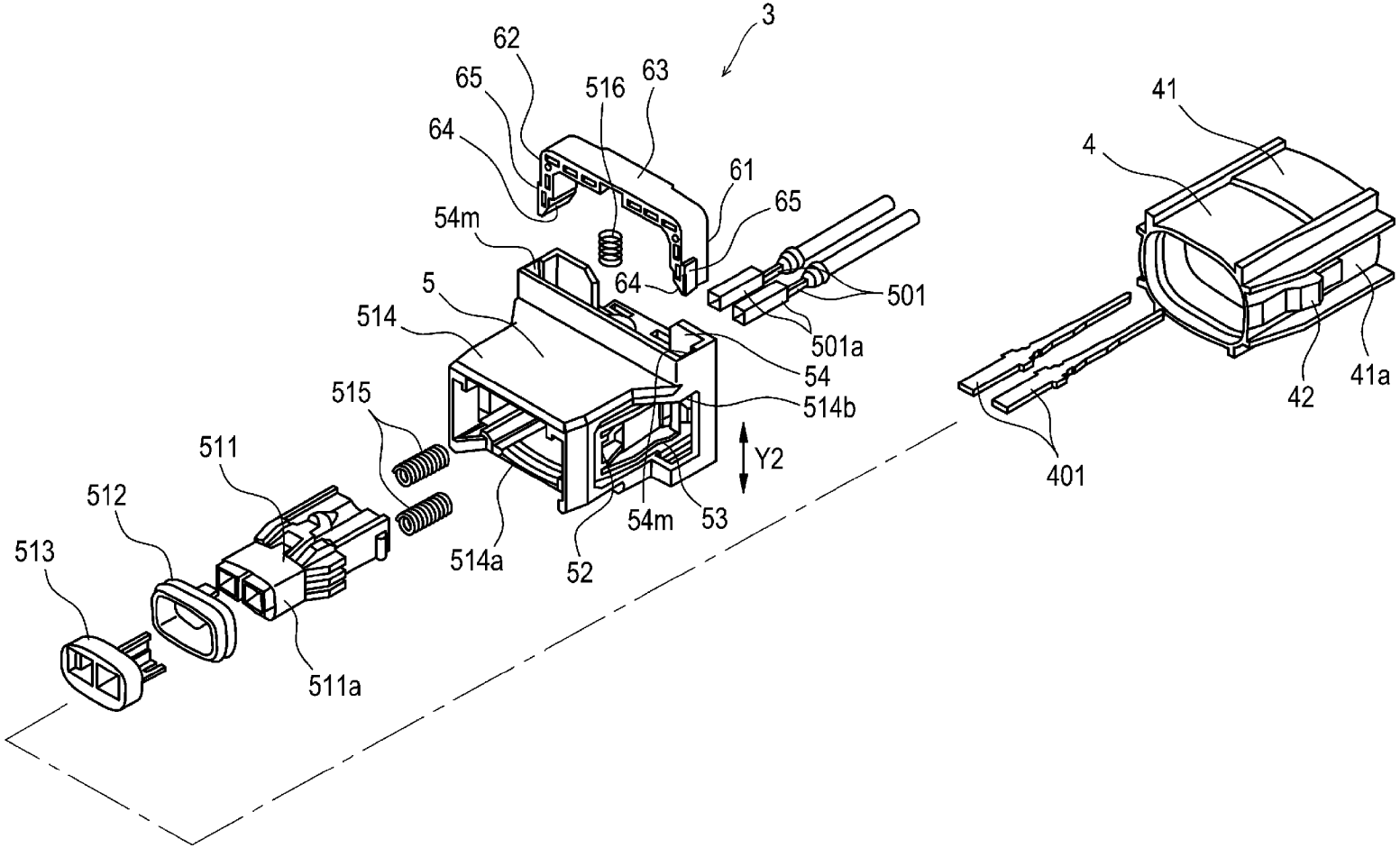
FIG. 2 is an exploded perspective view of the connector according to the embodiment of the present invention.
Figure 3:
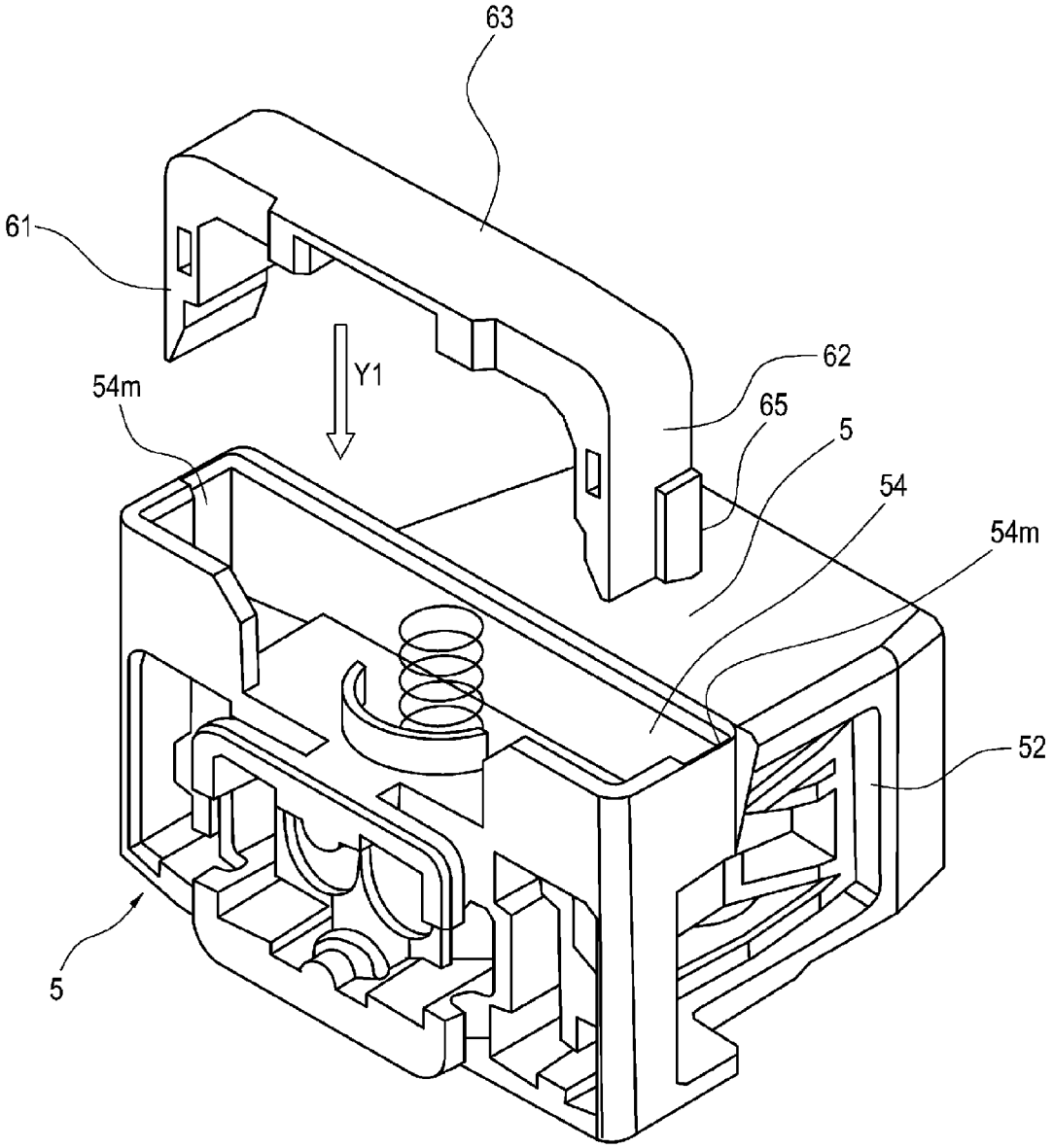
FIG. 3 is a perspective view of the connector housing according to the embodiment of the present invention, with the unlocking member yet to be assembled into the connector housing.
Figure 4:
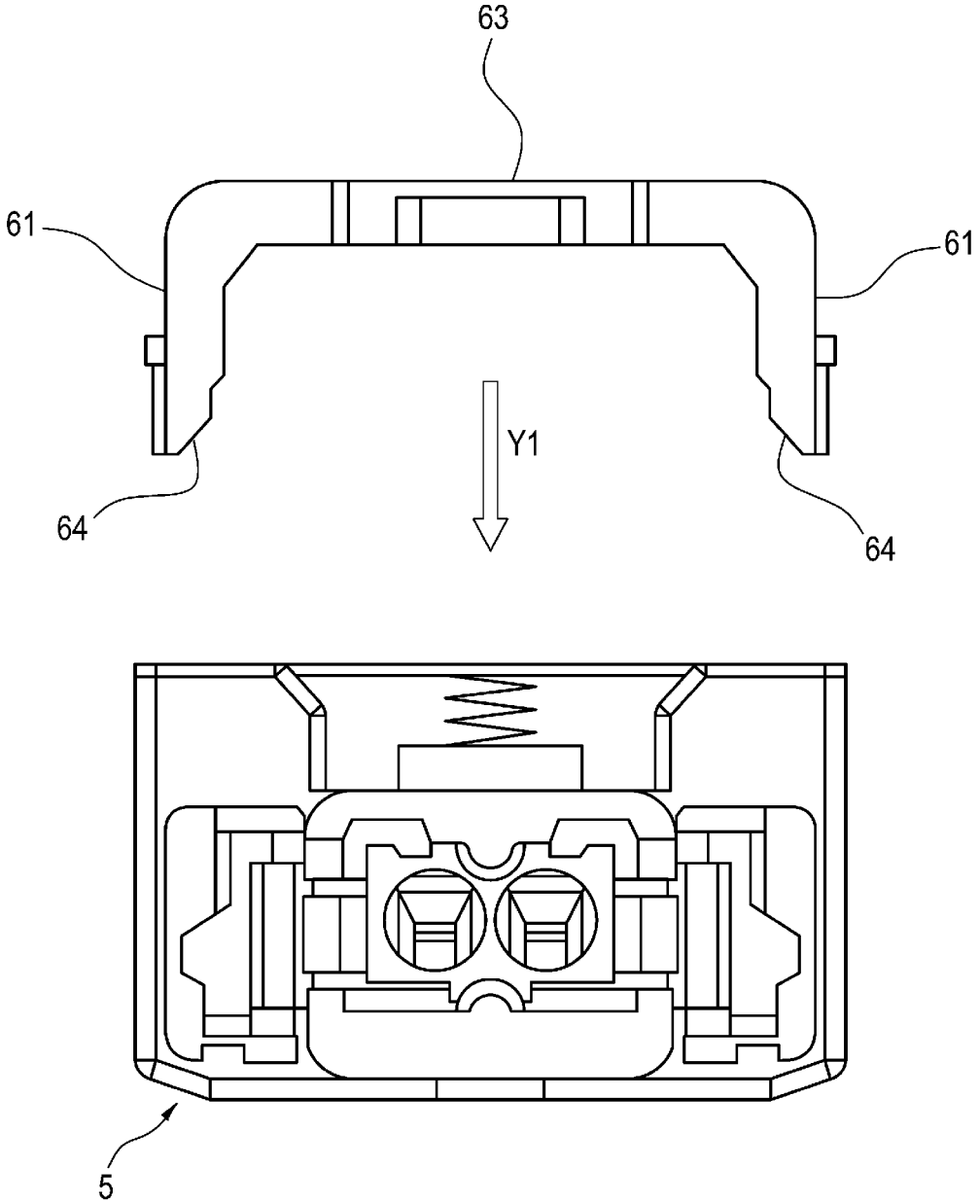
FIG. 4 is a rear view of the connector housing and the unlocking member illustrated in FIG. 3.
Figure 5:
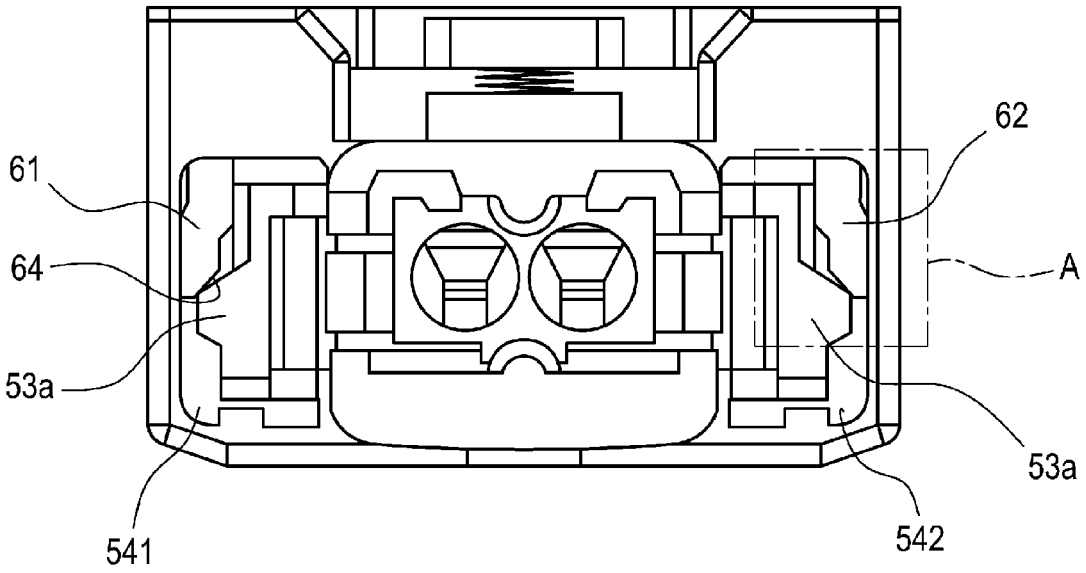
FIG. 5 is a rear view of the connector housing according to the embodiment of the present invention, with the unlocking member temporarily retained in the connector housing.
Figure 6:
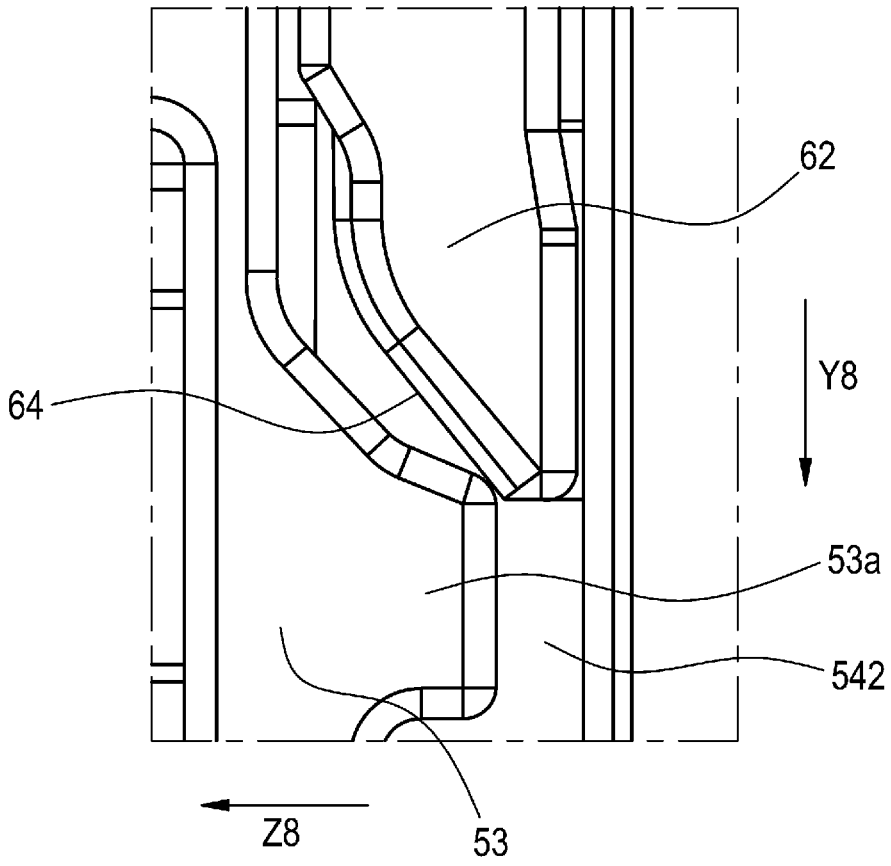
FIG. 6 is an enlarged view of the region A in FIG. 5.
Figure 7:
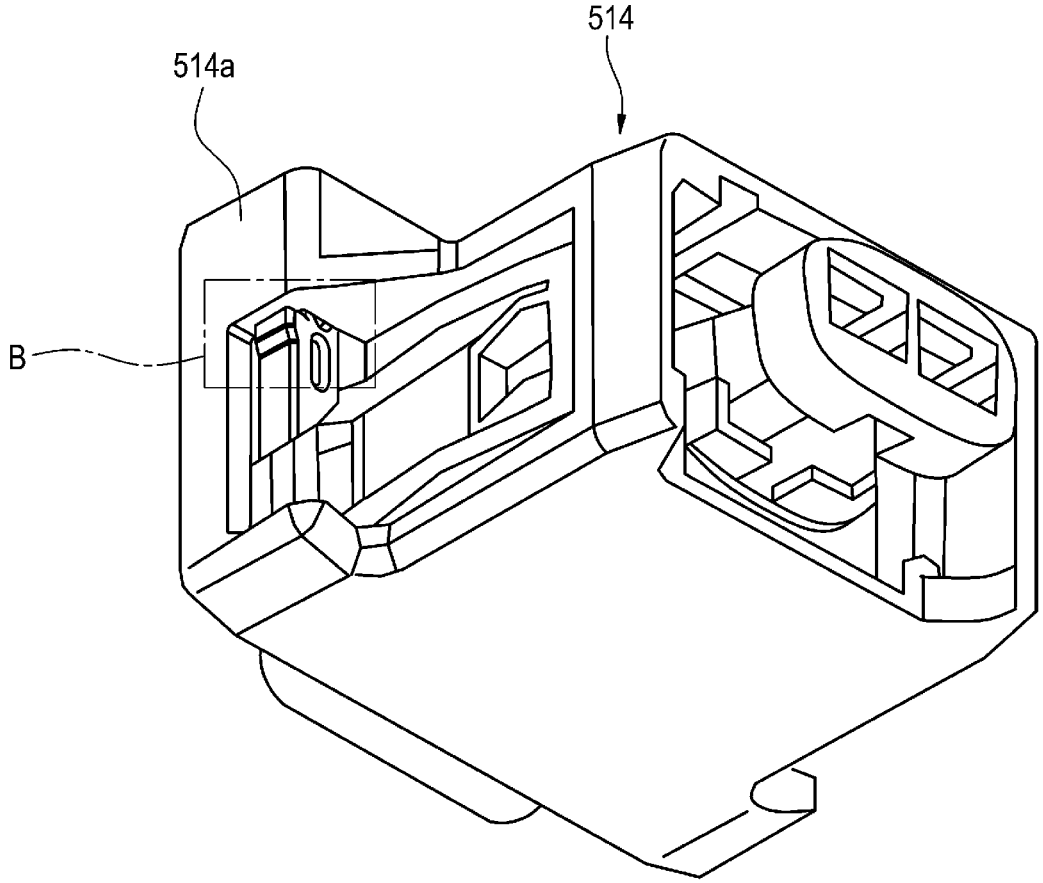
FIG. 7 is a perspective view of the connector housing according to the embodiment of the present invention, as viewed from the lower front lateral portion of the connector housing in which the unlocking member is temporarily retained.
Figure 8:
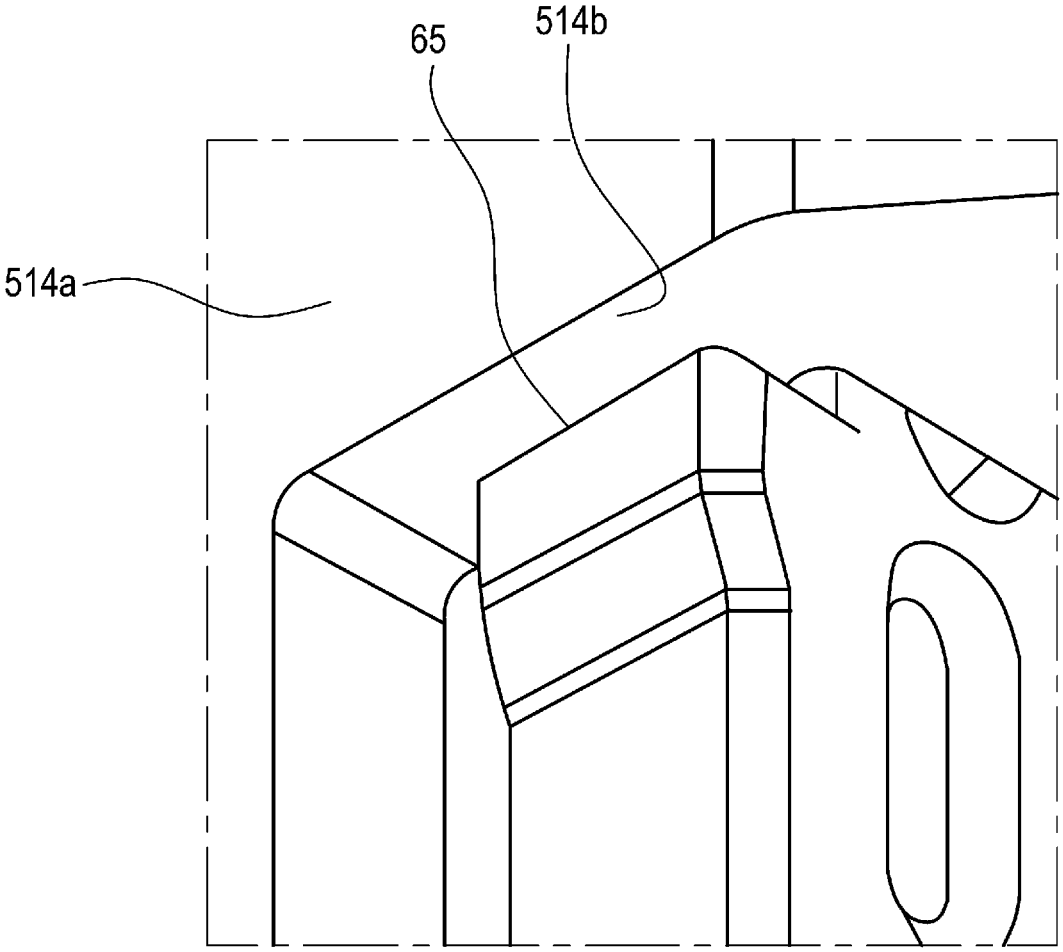
FIG. 8 is an enlarged view of the region B in FIG. 7.
Figure 9:
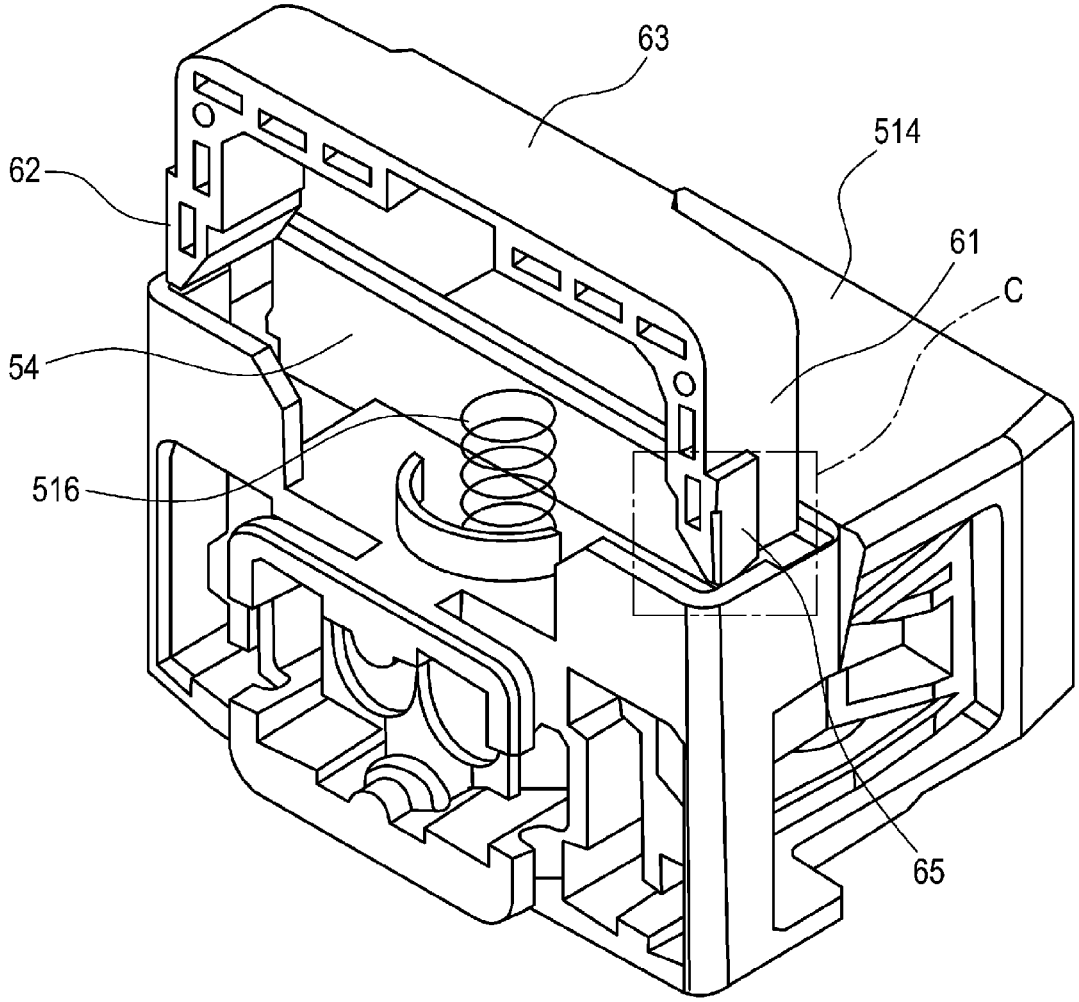
FIG. 9 is a perspective view of the connector housing according to the embodiment of the present invention, illustrating how the unlocking member is improperly assembled into the connector housing, with the front and rear of the unlocking member reversed.
Figure 10:
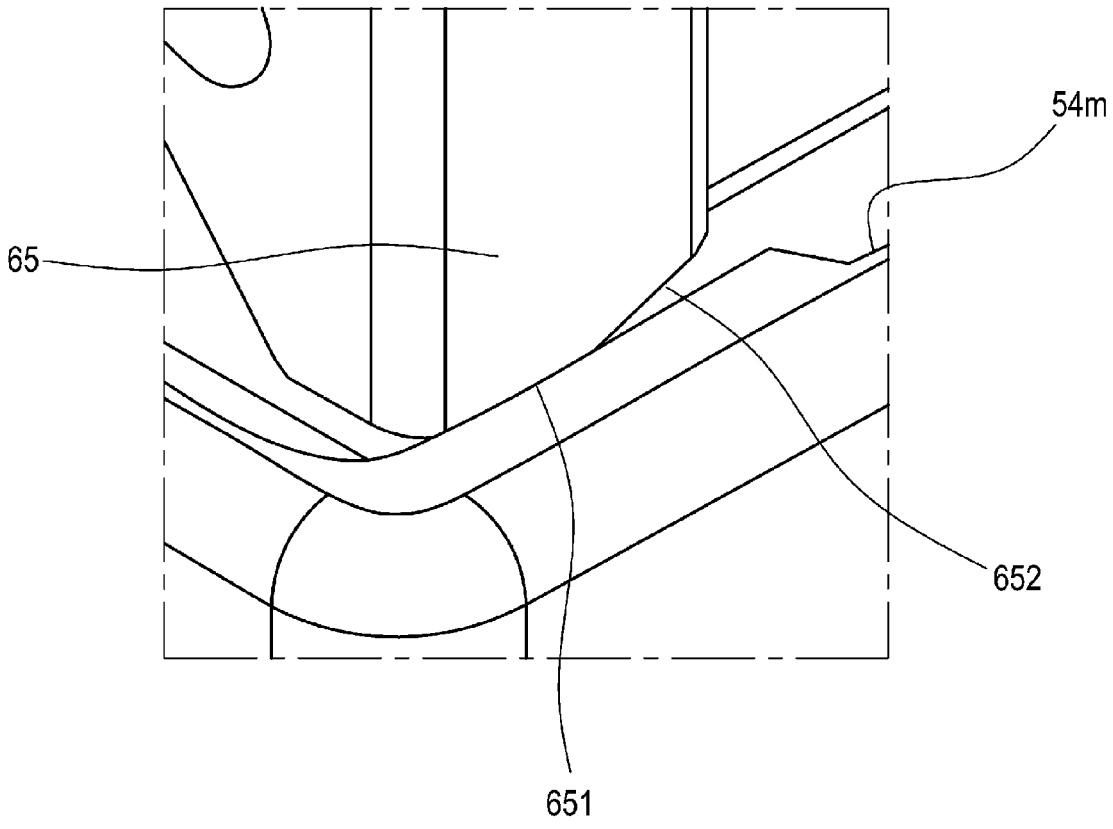
FIG. 10 is an enlarged view of the region C in FIG. 9.
Figure 11:
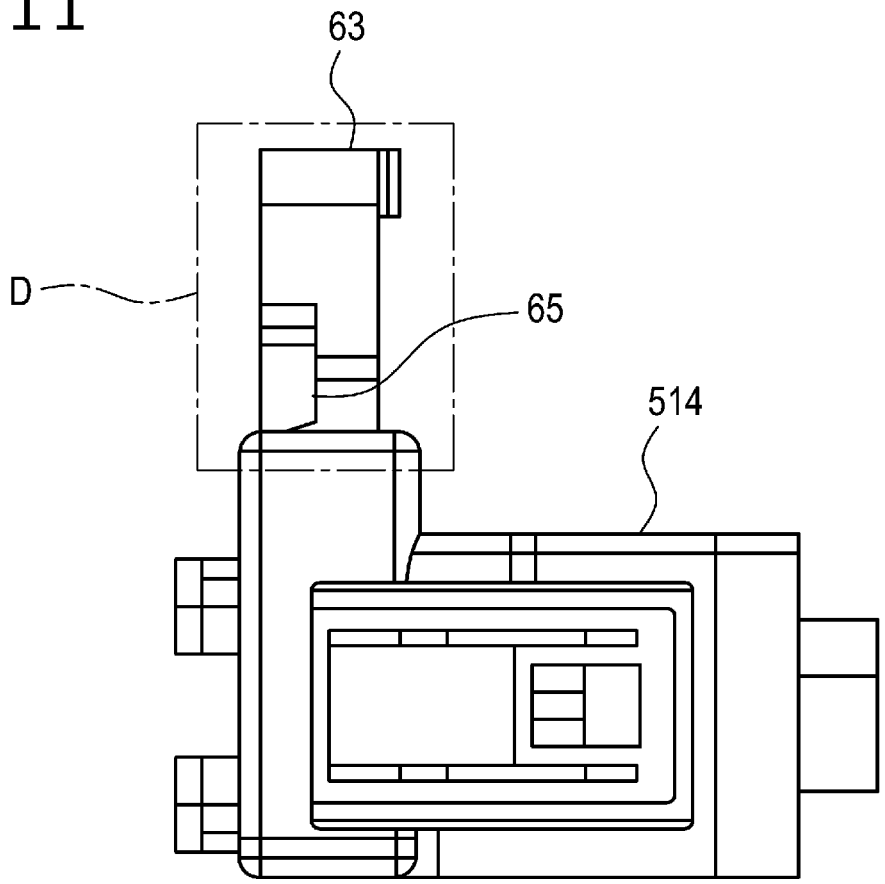
FIG. 11 is a side view of the connector housing illustrated in FIG. 9.
Figure 12:
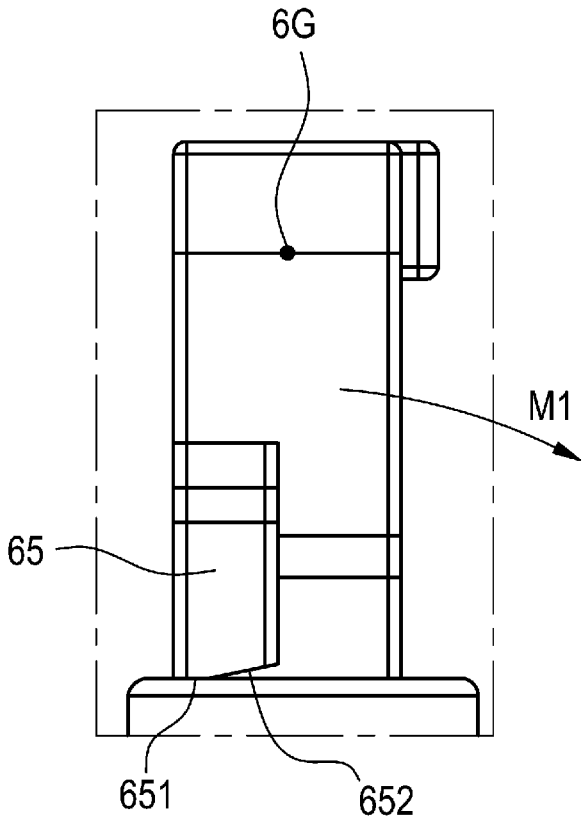
FIG. 12 is an enlarged view of the region D in FIG. 11.
Figure 13:
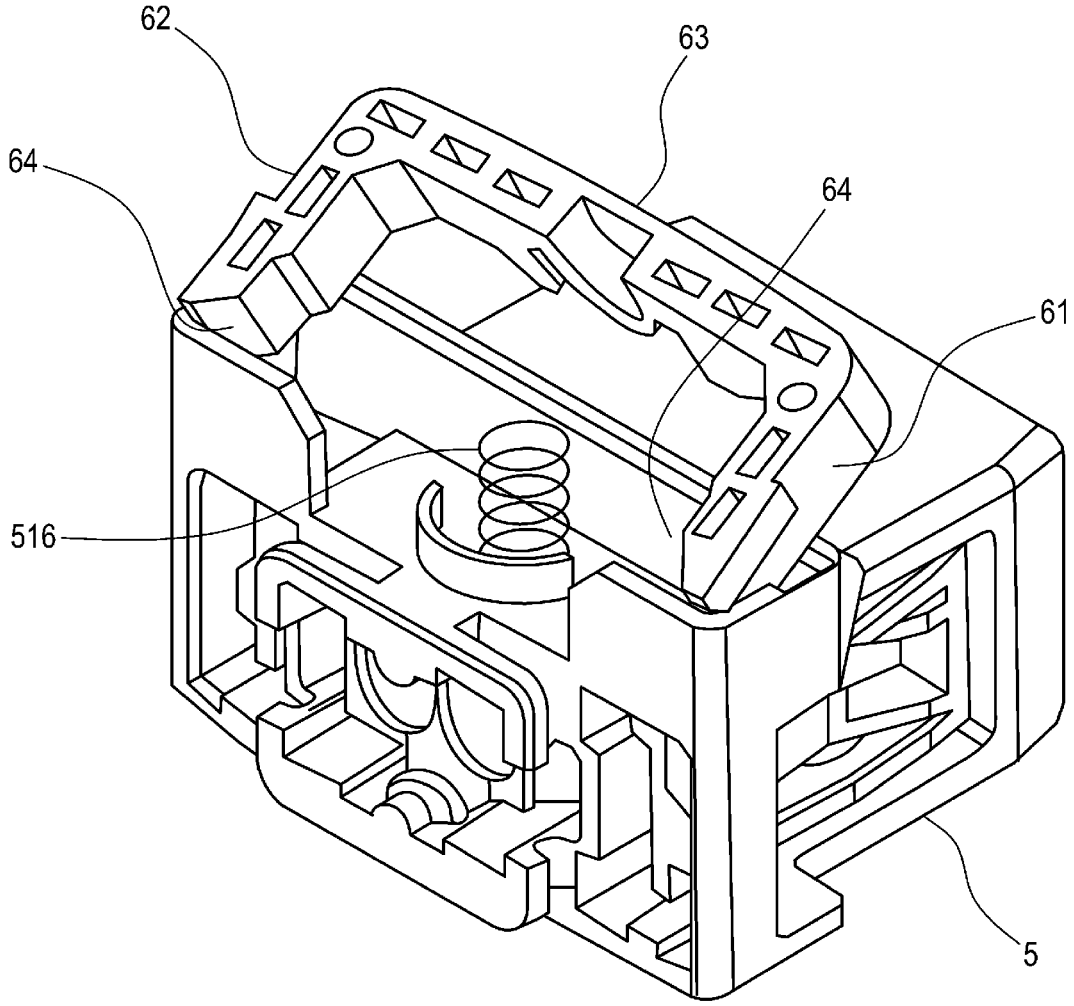
FIG. 13 is a perspective view of the connector housing according to the embodiment of the present invention into which the unlocking member is improperly assembled, with the unlocking member being tilted.
Figure 14:
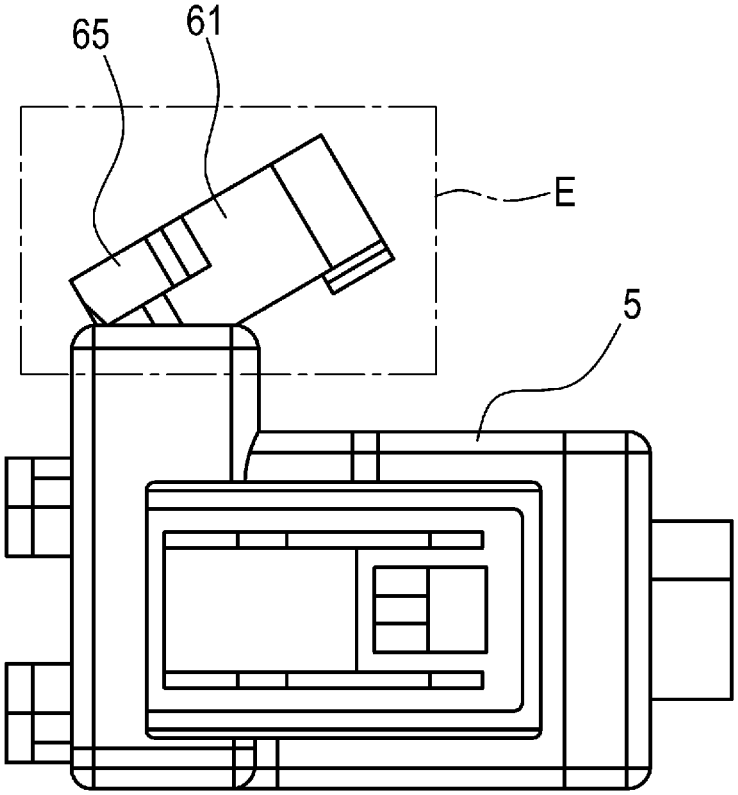
FIG. 14 is a side view of the connector housing illustrated in FIG. 13.
Figure 15:
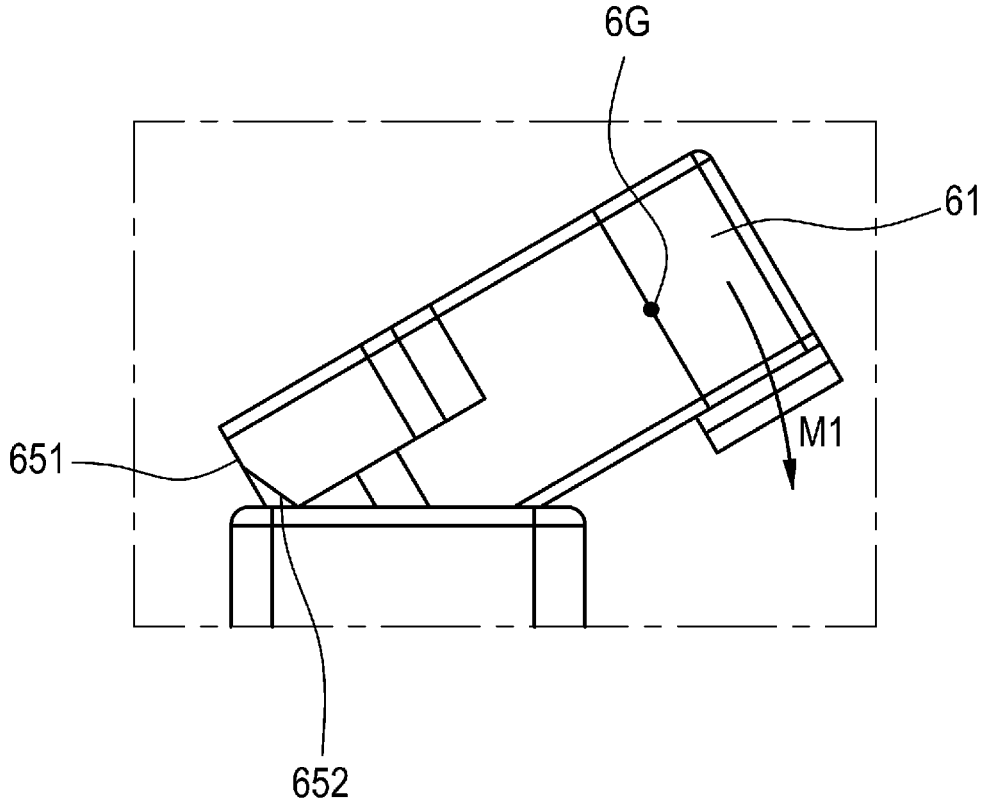
FIG. 15 is an enlarged view of the region E in FIG. 14.
Figure 16:
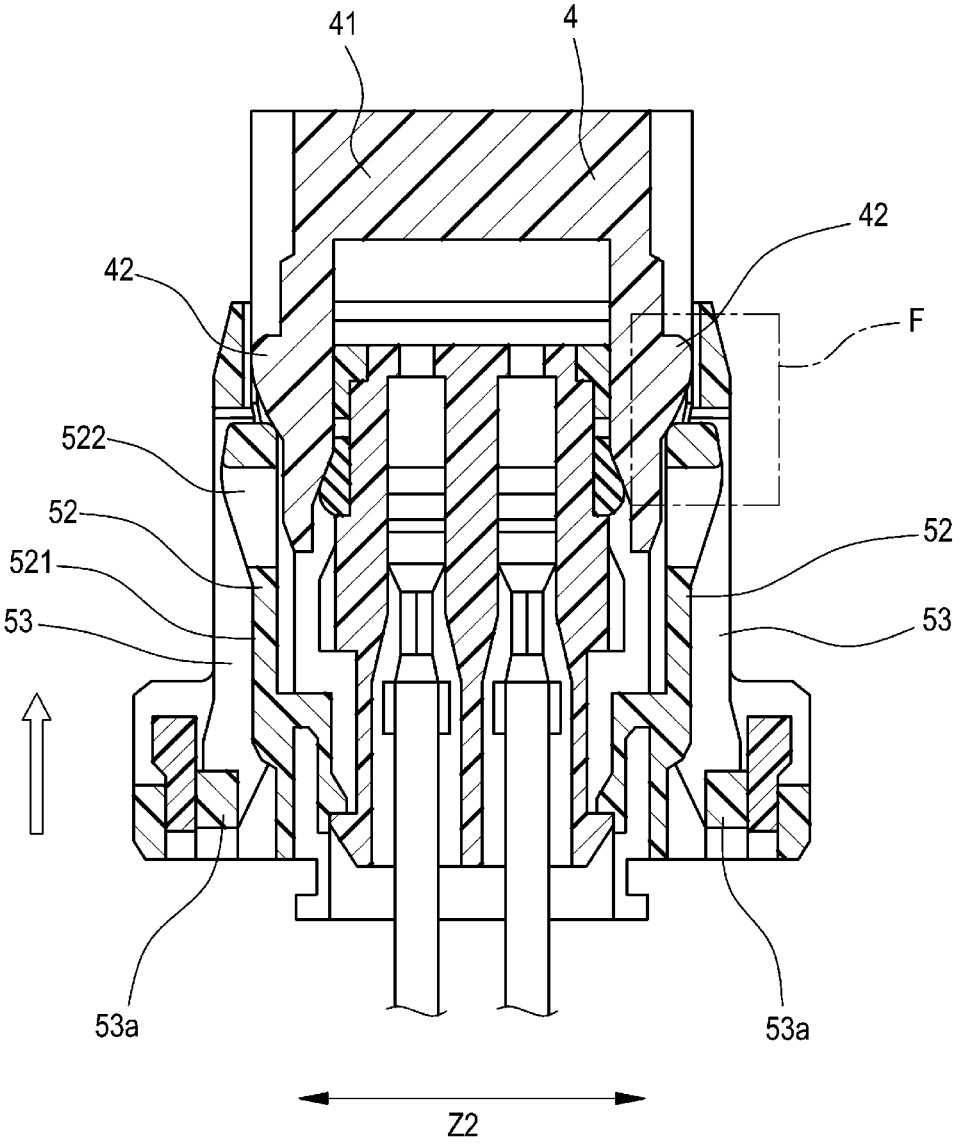
FIG. 16 is a longitudinal cross-sectional view of the connector housing in which the inventive unlocking member is temporarily retained, and the counterpart connector housing, with the connector housings abutting against each other at fitting start positions.
Figure 17:
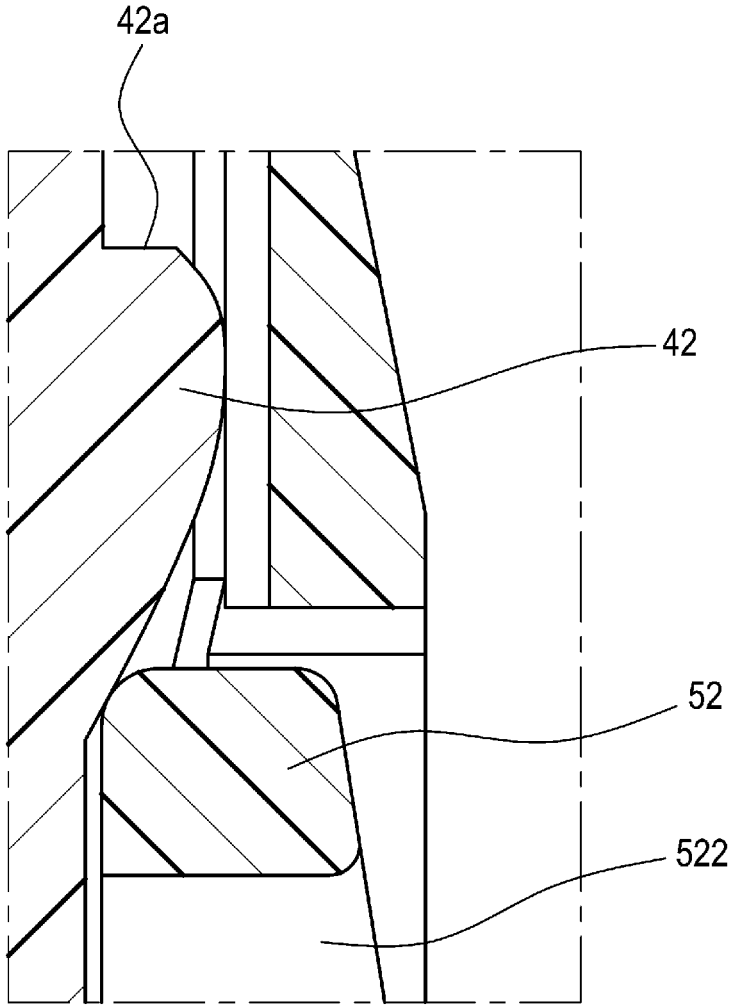
FIG. 17 is an enlarged view of the region F in FIG. 16.
Figure 18:
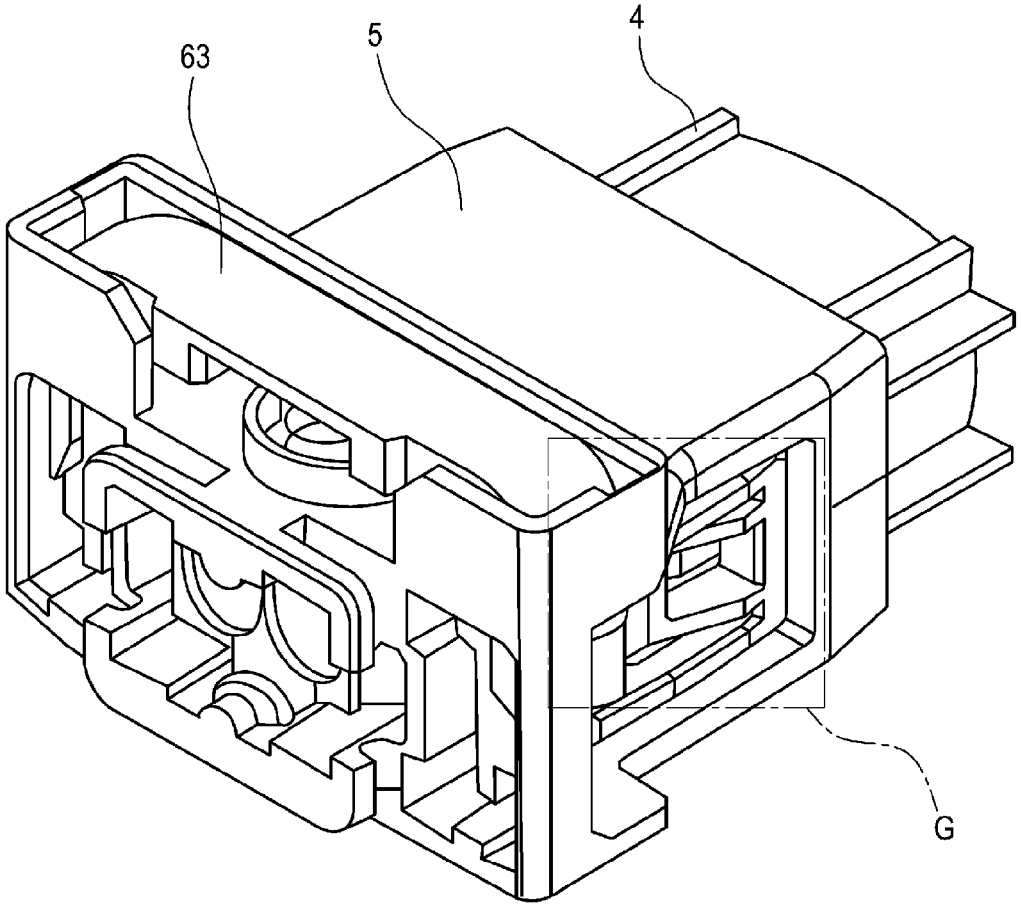
FIG. 18 is a perspective view of the connector housing and the counterpart connector housing illustrated in FIG. 16.
Figure 19:
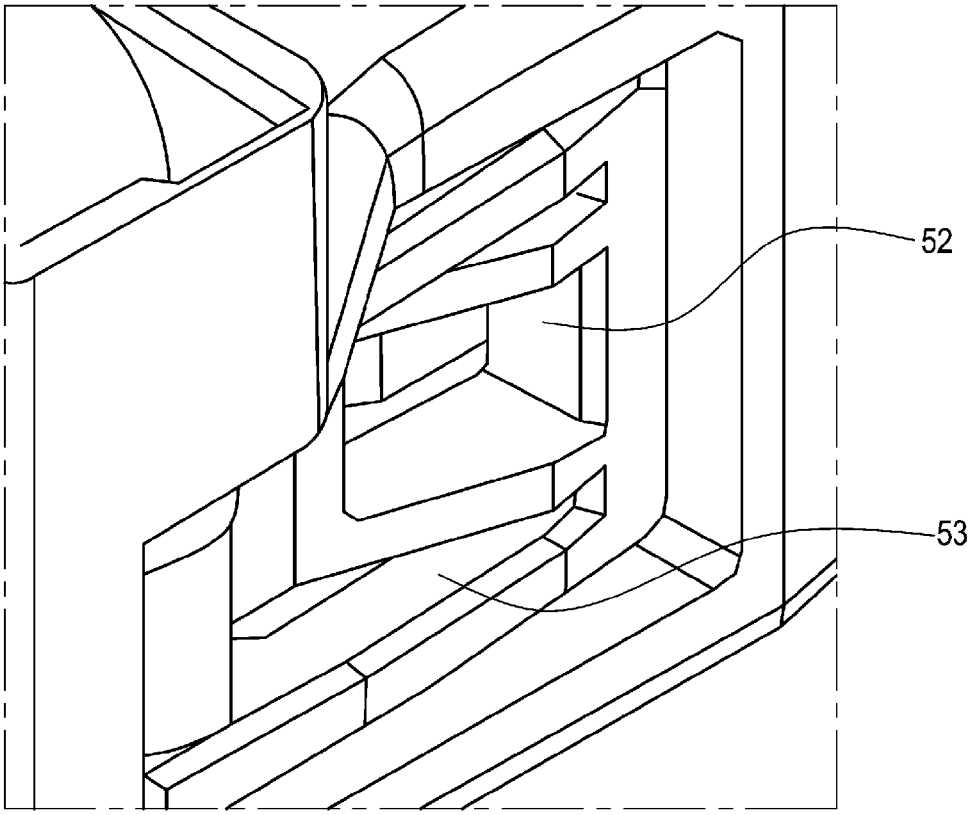
FIG. 19 is an enlarged view of the region G in FIG. 18.
Figure 20:
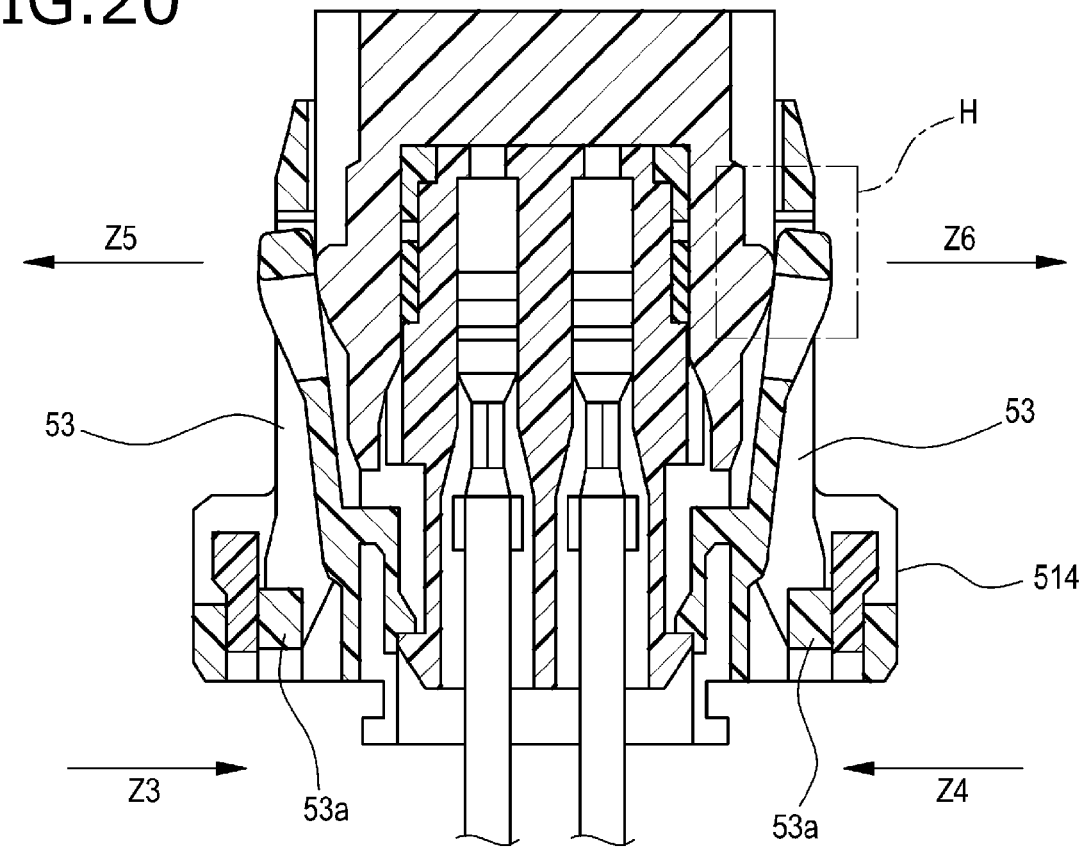
FIG. 20 is a longitudinal cross-sectional view of the connector housing and the counterpart connector housing according to the embodiment of the present invention immediately before being completely fitted to each other.
Figure 21:
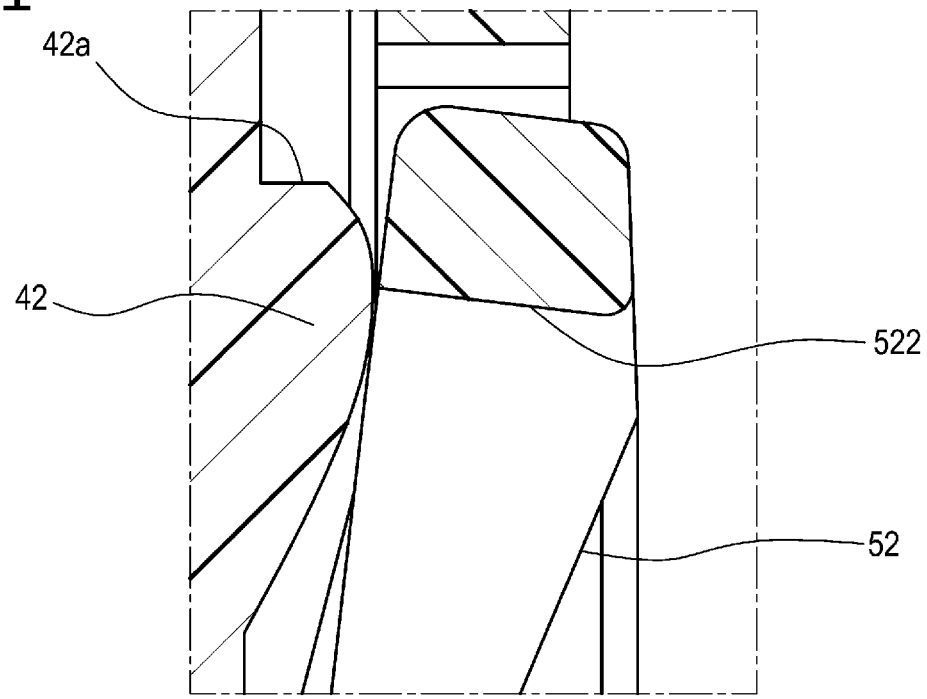
FIG. 21 is an enlarged view of the region H in FIG. 20.
Figure 22:
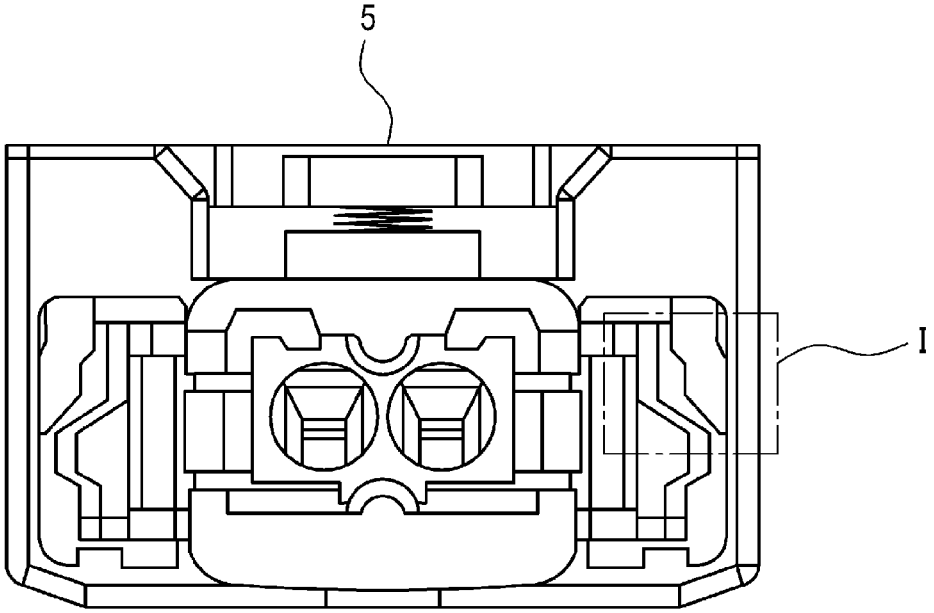
FIG. 22 is a rear view of the connector housing, illustrating the positional relationship between arm operating pieces and unlocking tapered surfaces of wedge pieces in the connector housing fitted to the counterpart connector housing as illustrated in FIG. 20.
Figure 23:
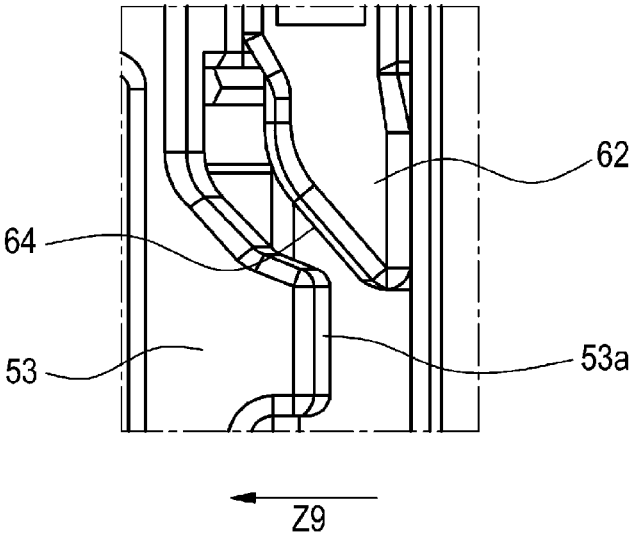
FIG. 23 is an enlarged view of the region I in FIG. 22.
Figure 24:
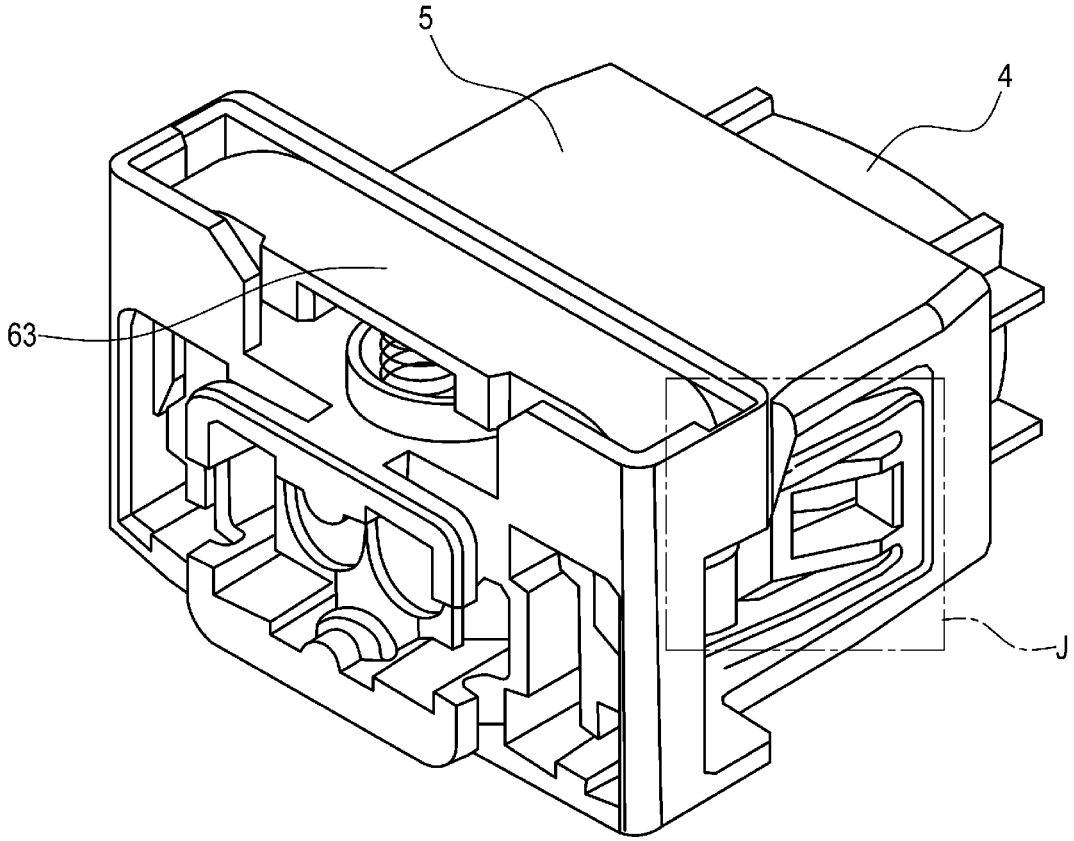
FIG. 24 is a perspective view of the connector, with the connector housings fitted to each other as illustrated in FIG. 20.
Figure 25:
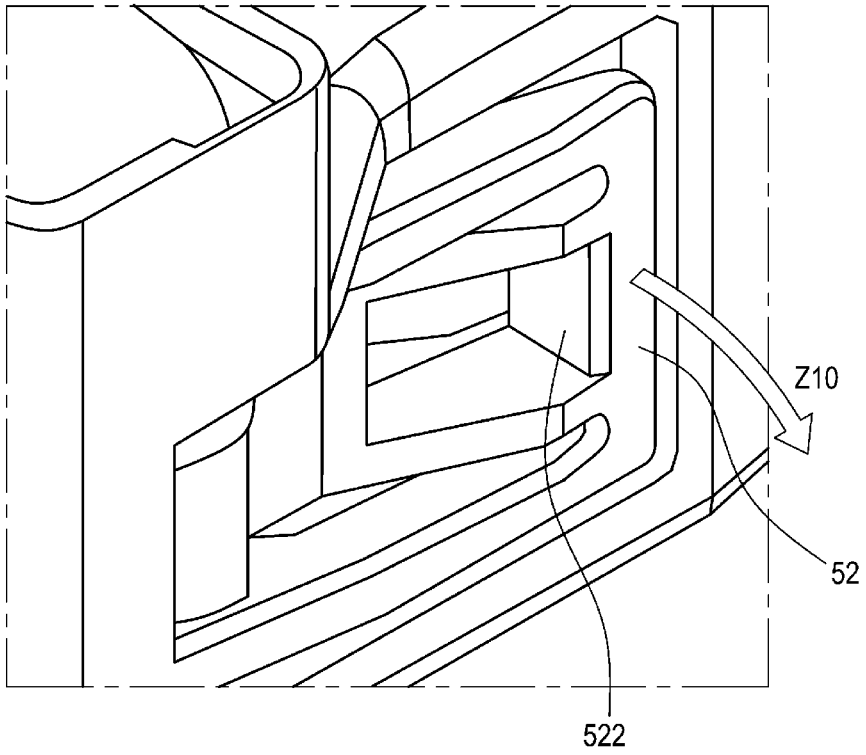
FIG. 25 is an enlarged view of the region J in FIG. 24.

FIGS. 1 to 25 illustrate the connector according to one embodiment of the present invention. FIG. 1 is an exploded perspective view of the connector according to the embodiment of the present invention including a connector housing in which an unlocking member is temporarily retained, and a counterpart connector housing. FIG. 2 is an exploded perspective view of the connector according to the embodiment of the present invention. FIG. 3 is a perspective view of the connector housing according to the embodiment of the present invention, with the unlocking member yet to be assembled into the connector housing. FIG. 4 is a rear view of the connector housing and the unlocking member illustrated in FIG. 3. FIG. 5 is a rear view of the connector housing according to the embodiment of the present invention, with the unlocking member temporarily retained in the connector housing. FIG. 6 is an enlarged view of the region A in FIG. 5. FIG. 7 is a perspective view of the connector housing according to the embodiment of the present invention, as viewed from the lower front lateral portion of the connector housing in which the unlocking member is temporarily retained. FIG. 8 is an enlarged view of the region B in FIG. 7. FIG. 9 is a perspective view of the connector housing according to the embodiment of the present invention, illustrating how the unlocking member is improperly assembled into the connector housing, with the front and rear of the unlocking member reversed. FIG. 10 is an enlarged view of the region C in FIG. 9. FIG. 11 is a side view of the connector housing illustrated in FIG. 9. FIG. 12 is an enlarged view of the region D in FIG. 11. FIG. 13 is a perspective view of the connector housing according to the embodiment of the present invention into which the unlocking member is improperly assembled, with the unlocking member being tilted. FIG. 14 is a side view of the connector housing illustrated in FIG. 13. FIG. 15 is an enlarged view of the region E in FIG. 14. FIG. 16 is a longitudinal cross-sectional view of the connector housing in which the inventive unlocking member is temporarily retained, and the counterpart connector housing, with the connector housings abutting against each other at fitting start positions. FIG. 17 is an enlarged view of the region F in FIG. 16. FIG. 18 is a perspective view of the connector housing and the counterpart connector housing illustrated in FIG. 16. FIG. 19 is an enlarged view of the region G in FIG. 18. FIG. 20 is a longitudinal cross-sectional view of the connector housing and the counterpart connector housing according to the embodiment of the present invention immediately before being completely fitted to each other. FIG. 21 is an enlarged view of the region H in FIG. 20. FIG. 22 is a rear view of the connector housing, illustrating the positional relationship between arm operating pieces and unlocking tapered surfaces of wedge pieces in the connector housing fitted to the counterpart connector housing as illustrated in FIG. 20. FIG. 23 is an enlarged view of the region I in FIG. 22. FIG. 24 is a perspective view of the connector, with the connector housings fitted to each other as illustrated in FIG. 20. FIG. 25 is an enlarged view of the region J in FIG. 24.

A connector 3 according to the present embodiment includes: a counterpart connector housing (male connector housing) 4; a connector housing (female connector housing) 5 to be fitted to the counterpart connector housing 4; a pair of oppositely facing connecting engagement portions 42, 42 protruding from a pair of outer surfaces 41*a*, 41*a* of the counterpart connector housing 4; a pair of lock arms 52, 52 integral with the lateral sides of the connector housing 5 and associated with the pair of connecting engagement portions 42, 42; arm operating pieces 53 extending from the lock arms 52; a pair of wedge pieces 61 and 62 to be assembled into a wedge insertion hole 54 in the connector housing 5; and unlocking tapered surfaces 64 on the inner surfaces of the distal ends of the pair of wedge pieces 61 and 62.

As illustrated in FIG. 2, the counterpart connector housing 4 includes a terminal holder 41 to hold male terminal metal fittings 401 for substrate connection. The above-mentioned connecting engagement portions 42 are integral with the pair of outer surfaces 41*a* of the terminal holder 41.

In the present embodiment, each connecting engagement portion 42 is an engagement protrusion projecting from the associated outer surface 41*a*. A vertical surface 42*a* (see FIG. 21) of the rear end of each protrusion is brought into engagement with the engagement recess 522 (see FIG. 21) of the associated lock arm 52 (which will be described below), thus locking the connector housings fitted to each other.

As illustrated in FIG. 2, the connector housing 5 includes: female terminal metal fittings 501 including terminal fitting portions 501*a* to which the male terminal metal fittings 401 are to be fitted and connected; an inner housing 511 containing and holding the female terminal metal fittings 501; a substantially tubular sealing 512 fitted and placed onto the outer periphery of a distal end 511*a* of the inner housing 511; a front holder 513 fitted and placed onto the distal end 511*a* of the inner housing 511; an outer housing 514 containing and holding the inner housing 511 so as to define a gap around the inner housing 511 such that the counterpart connector housing 4 is fitted into the gap; housing urging springs 515 urging the inner housing 511 inside the outer housing 514 forward; and a wedge urging means 516 urging a connection 63 connecting the pair of wedge pieces 61 and 62, such that the pair of wedge pieces 61 and 62 are retained at a standby position (which will be described below).

In fitting the counterpart connector housing 4 and the connector housing 5 to each other, the inner housing 511 is fitted into the terminal holder 41 of the counterpart connector housing 4, and the female terminal metal fittings 501 held in the inner housing 511 are fitted to the male terminal metal fittings 401 in the terminal holder 41.

The sealing 512 fitted to the outer periphery of the distal end 511*a* of the inner housing 511 seals the gap between a portion of the inner housing 511 and a portion of the counterpart connector housing 4 fitted to each other.

The front holder 513 is fitted to the distal end 511*a* of the inner housing 511 so as to determine the positioning of the distal ends of the female terminal metal fittings 501 contained in the inner housing 511, and to prevent the sealing 512 from being detached from the distal end 511*a*.

As illustrated in FIG. 1, the outer housing 514 includes an outer tubular portion 514*a* that surrounds the periphery of the counterpart connector housing 4 fitted to the inner housing 511. The pair of lock arms 52 are provided on the lateral sides of the outer tubular portion 514*a* which are to face the outer surfaces 41*a* of the counterpart connector housing 4.

As illustrated in FIG. 16, each lock arm 52 includes: an elastic piece 521 extending from a location adjacent to the base end of the outer housing 514 toward its distal end, and elastically deformable in the width direction of the outer housing 514 (i.e., the direction indicated by the arrow Z2 in FIG. 16); and the engagement recess 522 which is provided in the distal end of the elastic piece 521 and with which the associated connecting engagement portion 42 is to be engaged when the counterpart connector housing 4 and the connector housing 5 are completely fitted to each other.

The connecting engagement portions 42 of the counterpart connector housing 4 come into engagement with the engagement recesses 522 of the pair of lock arms 52 so as to restrict disengaging movement of the counterpart connector housing 4, thus locking the connector housings fitted to each other.

As illustrated in FIG. 16, each arm operating piece 53 extends from the front end of the associated lock arm 52 toward the base end of the outer housing 514. An end 53*a* of each arm operating piece 53 adjacent to the base end of the outer housing 514 is a free end. When the ends 53*a* are pressed inward in the width direction of the outer housing 514 as indicated by the arrows Z3 and Z4 in FIG. 20, the distal ends of the lock arms 52 connected with the arm operating pieces 53 are deflected and displaced outward in the width direction of the housing as indicated by the arrows Z5 and Z6 in FIG. 20. The outward deflection and displacement of the distal ends of the lock arms 52 in the width direction of the housing causes the lock arms 52 and the connecting engagement portions 42 to be disengaged and unlocked from each other.

In other words, pressing the free ends of the arm operating pieces 53 toward an inner space of the connector housing 5 deflects the lock arms 52 in the direction in which the lock arms 52 are disengaged from the connecting engagement portions 42.

The wedge insertion hole 54 is a cavity in which the pair of wedge pieces 61 and 62 and the connection 63, connecting the base ends of the pair of wedge pieces 61 and 62, are to be contained. Portions of the wedge insertion hole 54 located at the widthwise ends of the outer housing 514 are wedge insertion portions 541 and 542 into which the wedge pieces 61 and 62 are to be inserted, respectively.

The wedge insertion portions 541 and 542 extend along the up-down direction of the housing (i.e., the direction indicated by the arrow Y2 in FIG. 2) perpendicular to the direction in which the connector housings are to be fitted to each other. The wedge insertion portions 541 and 542 are disposed so that the ends 53*a* of the arm operating pieces 53 protrude into the wedge insertion portions 541 and 542. Accordingly, as illustrated in FIGS. 5 and 6, the ends 53*a* of the arm operating pieces 53 protrude toward the distal ends of the wedge pieces 61 and 62 respectively inserted into the wedge insertion portions 541 and 542. When the pair of wedge pieces 61 and 62 are pushed to an unlocking position (which will be described below), the distal ends of the pair of wedge pieces 61 and 62 interfere with the ends 53*a*.

As illustrated in FIG. 2, the inner surfaces of the wedge insertion portions 541 and 542 adjacent to the front ends thereof are provided with grooves 54*m* extending in the up-down direction of the housing. Engagement protrusions 65 protruding from the outer surfaces of the distal ends of the pair of wedge pieces 61 and 62 are allowed to move along the grooves 54*m*. Because the grooves 54*m* are provided adjacent to the front end of the housing, the wedge insertion hole 54, including the wedge insertion portions 541 and 542, has asymmetrical front and rear horizontal cross-sectional shapes.

The base ends of the pair of wedge pieces 61 and 62 are connected to each other with the connection 63, so that the pair of wedge pieces 61 and 62 are integral with each other. Accordingly, the pair of wedge pieces 61 and 62 are assembled as a single component into the wedge insertion hole 54.

As illustrated in FIG. 6, the inner surfaces of the distal ends of the pair of wedge pieces 61 and 62 are provided with the unlocking tapered surfaces 64 that gradually increase in thickness toward the base ends of the wedge pieces 61 and 62. As illustrated in FIG. 2, the engagement protrusions 65 protrude from one side of the outer surfaces of the distal ends of the pair of wedge pieces 61 and 62 (i.e., from portions of the outer surfaces of the distal ends of the pair of wedge pieces 61 and 62 to be located adjacent to the distal end of the housing).

When the pair of wedge pieces 61 and 62 are pushed to the unlocking position from the standby position (which will be described below) as indicated by the arrow Y8 in FIG. 6, the unlocking tapered surfaces 64 press the ends 53*a* of the arm operating pieces 53 toward the inner space of the housing as indicated by the arrow Z8 in FIG. 6. This causes the pair of lock arms 52, 52 to deflect and deform in the direction in which the pair of connecting engagement portions 42, 42 are disengaged from the lock arms 52. Thus, the connecting engagement portions 42 are unlocked from the lock arms 52.

When the pair of wedge pieces 61 and 62 are inserted into the wedge insertion hole 54 in the outer housing 514 and reach the standby position, the engagement protrusions 65 come into engagement with engagement segments 514*b* of the outer tubular portion 514*a* of the outer housing 514 as illustrated in FIGS. 7 and 8. This prevents the pair of wedge pieces 61 and 62 from moving out of the standby position.

The engagement segments 514*b* are segments of the outer housing 514 that are involved in neither deflection nor deformation of the lock arms 52. Thus, when the lock arms 52 are deflected and deformed so as to be brought beyond the connecting engagement portions 42 in fitting the connector housings to each other, the engagement segments 514*b* enable a sufficient area of engagement between the engagement segments 514*b* and the engagement protrusions 65 which is affected by neither deflection nor deformation of the lock arms 52.

With the engagement protrusions 65 abutting against (or in engagement with) the engagement segments 514*b*, the pair of wedge pieces 61 and 62 are urged by the urging force of the wedge urging means 516 exerted on the connection 63, such that the abutment of the engagement protrusions 65 against the engagement segments 514*b* is maintained. In other words, the pair of wedge pieces 61 and 62 are urged by the urging force of the wedge urging means 516 so that the pair of wedge pieces 61 and 62 are retained at the standby position.

The pair of wedge pieces 61 and 62 are temporarily fixed at the standby position in the connector housing 5 illustrated in FIG. 1. In this state, pressing the connection 63 allows the pair of wedge pieces 61 and 62 to be pushed down from the standby position to the unlocking position against the urging force of the wedge urging means 516.

The pair of wedge pieces 61 and 62 according to the present embodiment are assembled into the wedge insertion hole 54 in the outer housing 514, and held in the outer housing 514 such that the wedge pieces 61 and 62 are movable between the standby position and the unlocking position which are located away from each other in the housing up-down direction perpendicular to the direction in which the connector housings are fitted to each other. Pressing the pair of wedge pieces 61 and 62 to the unlocking position releases the locking of the connector housings fitted to each other effected by the lock arms 52.

In the present embodiment, the engagement protrusions 65 protrude from the outer surfaces of the distal ends of the wedge pieces 61 and 62. Thus, the distal ends of the pair of wedge pieces 61 and 62 each have asymmetrical front and rear cross-sectional shapes.

In other words, the connector 3 according to the present embodiment includes the pair of wedge pieces 61 and 62 and the wedge insertion hole 54 each having asymmetrical front and rear cross-sectional shapes.

As illustrated in FIGS. 10 and 12, the engagement protrusions 65 of the pair of wedge pieces 61 and 62 according to the present embodiment are deviated from the center of gravity 6G of the wedge pieces 61 and 62. Distal surfaces 651 of the engagement protrusions 65 abut against the peripheral edge of the wedge insertion hole 54 of the outer housing 514 into which the wedge pieces 61 and 62 are improperly inserted. End portions of the distal surfaces 651 adjacent to the center of gravity are provided with tapered surfaces 652 to allow the wedge pieces 61 and 62 abutting against the peripheral edge of the wedge insertion hole 54 to tilt.

Suppose that an attempt is made to assemble the pair of wedge pieces 61 and 62 described above into the wedge insertion hole 54, with the front and rear of the pair of wedge pieces 61 and 62 reversed. In that case, the pair of wedge pieces 61 and 62 act as follows. As illustrated in FIG. 12, at the time when the distal surfaces 651 of the engagement protrusions 65 abut against the peripheral edge of the wedge insertion hole 54, the self-weight load on the center of gravity 6G of the pair of wedge pieces 61 and 62 acts as a rotation moment M1 to tilt the pair of wedge pieces 61 and 62 using the tapered surfaces 652 as supporting points. Thus, as illustrated in FIGS. 13 to 15, the pair of wedge pieces 61 and 62 are unable to stand on their own, so that the pair of wedge pieces 61 and 62 fall in no time. This immediately proves that the pair of wedge pieces 61 and 62 have been improperly assembled into the wedge insertion hole 54, with the front and rear of the pair of wedge pieces 61 and 62 reversed.

Next, referring to FIGS. 16 to 25, how the lock arms 52 and the arm operating pieces 53 act in fitting the counterpart connector housing 4 and the connector housing 5 to each other will be described.

FIGS. 16 to 19 illustrate the counterpart connector housing 4 and the connector housing 5 immediately before being fitted to each other. In this state, the lock arms 52 are not yet brought onto the connecting engagement portions 42. Thus, neither the lock arms 52 nor the arm operating piece 53 are deflected or deformed.

FIGS. 20 to 25 illustrate the counterpart connector housing 4 and the connector housing 5 being fitted to each other, with the connecting engagement portions 42 immediately before being engaged with the engagement recesses 522 of the lock arms 52. In this state, as illustrated in FIG. 21, the lock arms 52 are brought onto the connecting engagement portions 42. This causes the lock arms 52 to deflect and deform, so that the distal ends of the lock arms 52 displace toward an outer space of the housing as indicated by the arrow Z10 in FIG. 25. The ends 53*a* of the arm operating pieces 53 displace toward the inner space of the housing as indicated by the arrow Z9 in FIG. 23, thus increasing the gaps between the ends 53*a* and the pair of wedge pieces 61 and 62.

Although not illustrated, when the counterpart connector housing 4 and the connector housing 5 are completely fitted to each other, the connecting engagement portions 42 come into engagement with the engagement recesses 522 of the lock arms 52. Thus, the lock arms 52 return to their original shapes, causing the ends 53*a* of the arm operating pieces 53 to assume their initial positions illustrated in FIG. 6.

The connector 3 according to the above-described embodiment is configured so that the pair of wedge pieces 61 and 62 and the wedge insertion hole 54, into which the pair of wedge pieces 61 and 62 are to be inserted, each have asymmetrical front and rear cross-sectional shapes. Thus, when an attempt is made to assemble the pair of wedge pieces 61 and 62 into the connector housing, with the front and rear of the pair of wedge pieces 61 and 62 reversed, the pair of wedge pieces 61 and 62 will not be inserted into the wedge insertion hole 54 of the connector housing 4. Consequently, improper insertion of the unlocking member is prevented with reliability.

The connector 3 according to the present embodiment is configured so that the engagement segments 514*b* of the connector housing 5, which are in engagement with the engagement protrusions 65 of the pair of wedge pieces 61 and 62 at the standby position, are involved in neither deflection nor deformation of the lock arms 52. Thus, when the lock arms 52 deflect and deform in the course of fitting the connector housings to each other, the area of engagement between the engagement protrusions 65 of the wedge pieces 61 and 62 and the engagement segments 514*b* of the connector housing 5 will not decrease. Accordingly, the temporary retainment of the wedge pieces will not be loosened by the decrease in the area of engagement between the engagement protrusions 65 of the wedge pieces 61 and 62 and the engagement segments 514*b* of the connector housing 5. Consequently, the temporary engagement of the wedge pieces with the connector housing 5 is maintained with stability, and thus the reliability of the temporary retainment of the wedge pieces is improved.

The connector 3 according to the present embodiment is configured so that if the unlocking member is improperly assembled into the connector housing 5, the wedge pieces 61 and 62 assembled into the connector housing 5 will tilt under the load applied to the center of gravity of the wedge pieces 61 and 62, with the tapered surfaces on the distal surfaces of the engagement protrusions 65 serving as the supporting points. Consequently, improper assembly of the unlocking member into the connector housing 5 is detected with ease and reliability.

The present invention is not limited to the above-described embodiment. Changes or modifications, for example, may be made to the present invention as deemed appropriate. Each constituent element in the above-described embodiment is not limited to any particular material, shape, size, number, arrangement, or location, for example. A material for each constituent element may be any material suitable for carrying out the invention. Each constituent element may have any shape or size suitable for carrying out the invention. The number of each constituent element may be any number suitable for carrying out the invention. The arrangement or location of each constituent element may be any arrangement or location suitable for carrying out the invention.

For example, the connecting engagement portions 42 may be provided on the inner surface of the counterpart connector housing 4 instead of the outer surface of the counterpart connector housing 4. The connecting engagement portions 42 may be recesses in the counterpart connector housing 4 instead of the protrusions from the counterpart connector housing 4.

The features of the connector and the connection structure according to the embodiment of the present invention described thus far are summarized as follows.

(1) A connector (3) including:

a connector housing (5) configured to be fitted to a counterpart connector housing (4);

a pair of lock arms (52, 52) integrally formed on the connector housing (5) and configured to be engaged with a pair of connecting engagement portions (42, 42) of the counterpart connector housing (4) to lock a state where the connector housings fitted to each other;

a pair of wedge pieces (61, 62) configured to be assembled into a wedge insertion hole (54) in the connector housing (5) so as to be movable from a standby position to an unlocking position in the connector housing (5), the pair of wedge pieces (61, 62) being configured to release, when the pair of wedge pieces are pressed to the unlocking position, a locking of the connector housings fitted to each other effected by the lock arms (52); and wherein each of the wedge pieces (61, 62) and the wedge insertion hole (54) has an asymmetrical front and rear cross-sectional shape.

(2) The connector (3) according to the item (1), wherein engagement protrusions (65) are provided at distal end outer surfaces of the wedge pieces (61, 62);

wherein the engagement protrusions (65) are engaged with engagement segments (514*b*) to prevent the wedge pieces (61, 62) from moving out of the standby position, engagement segments (514*b*) being formed at a portion of the connector housing (5) where deflection and deformation of the lock arms (52) are not affected when the wedge pieces (61, 62) are at the standby position; and wherein each of the engagement protrusions (65) has an asymmetrical front and rear cross-sectional shape.

(3) The connector (3) according to the item (2), wherein the engagement protrusions (65) of the wedge pieces (61) are deviated from a center of gravity of the wedge pieces (61); and wherein end portions of distal surfaces of the engagement protrusions (65) close to the center of gravity are provided with inclined surfaces (652) to allow the wedge pieces (61) abutting against a peripheral edge of the wedge insertion hole (54) to tilt.

(4) A connection structure of a connector for connecting a counterpart connector housing (4) and a connector housing (5) configured to be fitted to the counterpart connector housing (4), the connection structure including:

a pair of lock arms (52, 52) integrally formed on the connector housing (5), and configured to be engaged with a pair of connecting engagement portions (42,42) of the counterpart connector housing (4) to lock a state where the connector housings (4,5) fitted to each other;

a pair of wedge pieces (61, 62) configured to be assembled into a wedge insertion hole (54) in the connector housing (4) so as to be movable from a standby position to an unlocking position in the counterpart connector housing (4), the pair of wedge pieces (61, 62) being configured to release, when the pair of wedge pieces (61, 62) are pressed to the unlocking position, a locking of the connector housings (4, 5) fitted to each other effected by the lock arms (52); and wherein each of the wedge pieces (61, 62) and the wedge insertion hole (54) has an asymmetrical front and rear cross-sectional shape.

What is claimed is:

1. A connector comprising:

a connector housing configured to be fitted to a counterpart connector housing:

a pair of lock arms integrally formed on the connector housing, and configured to be engaged with a pair of connecting engagement portions of the counterpart connector housing to lock a state where the connector housings fitted to each other; and a pair of wedge pieces configured to be assembled into a wedge insertion hole in the connector housing so as to be movable from a standby position to an unlocking position in the connector housing, the pair of wedge pieces being configured to release, when the pair of wedge pieces are pressed to the unlocking position, a locking of the connector housings fitted to each other effected by the lock arms; and wherein each of the wedge pieces and the wedge insertion hole has an asymmetrical front and rear cross-sectional shape;

wherein engagement protrusions are provided at distal end outer surfaces of the wedge pieces;

wherein the engagement protrusions are engaged with engagement segments to prevent the wedge pieces from moving out of the standby position, the engagement segments being formed at a portion of the connector housing where deflection and deformation of the lock arms are not affected when the wedge pieces are at the standby position; and wherein each of the engagement protrusions has an asymmetrical front and rear cross-sectional shape.

2. The connector according to claim 1, wherein the engagement protrusions of the wedge pieces are deviated from a center of gravity of the wedge pieces; and wherein end portions of distal surfaces of the engagement protrusions close to the center of gravity are provided with inclined surfaces to allow the wedge pieces abutting against a peripheral edge of the wedge insertion hole to tilt.

3. A connection structure of a connector for connecting a counterpart connector housing and a connector housing configured to be fitted to the counterpart connector housing, the connection structure comprising:

a pair of lock arms integrally formed on the connector housing, and configured to be engaged with a pair of connecting engagement portions of the counterpart connector housing to lock a state where the connector housings fitted to each other;

a pair of wedge pieces configured to be assembled into a wedge insertion hole in the connector housing so as to be movable from a standby position to an unlocking position in the connector housing, the pair of wedge pieces being configured to release, when the pair of wedge pieces are pressed to the unlocking position, a locking of the connector housings fitted to each other effected by the lock arms;

wherein each of the wedge pieces and the wedge insertion hole has an asymmetrical front and rear cross-sectional shape;

wherein engagement protrusions are provided at distal end outer surfaces of the wedge pieces;

wherein the engagement protrusions are engaged with engagement segments to prevent the wedge pieces from moving out of the standby position, the engagement segments being formed at a portion of the connector housing where deflection and deformation of the lock arms are not affected when the wedge pieces are at the standby position; and wherein each of the engagement protrusions has an asymmetrical front and rear cross-sectional shape.

4. The connection structure according to claim 3, wherein the engagement protrusions of the wedge pieces are deviated from a center of gravity of the wedge pieces; and wherein end portions of distal surfaces of the engagement protrusions close to the center of gravity are provided with inclined surfaces to allow the wedge pieces abutting against a peripheral edge of the wedge insertion hole to tilt.

* * * * *